US010425720B1

(12) United States Patent
Cho

(10) Patent No.: US 10,425,720 B1
(45) Date of Patent: Sep. 24, 2019

(54) COMPOSITE SPEAKER MODULE AND SPEAKER DEVICE

(71) Applicant: Chicony Electronics Co., Ltd., New Taipei (TW)

(72) Inventor: Tsung-Yen Cho, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 16/047,379

(22) Filed: Jul. 27, 2018

(30) Foreign Application Priority Data

May 3, 2018 (TW) ..... 107115122

(51) Int. Cl.
*H04R 1/28* (2006.01)
*H04R 31/00* (2006.01)
*H04R 1/02* (2006.01)

(52) U.S. Cl.
CPC ..... *H04R 1/2857* (2013.01); *H04R 1/025* (2013.01); *H04R 1/288* (2013.01); *H04R 31/006* (2013.01)

(58) Field of Classification Search
CPC ..... H04R 1/2857; H04R 1/025; H04R 1/288; H04R 31/006
USPC ..... 381/338
See application file for complete search history.

(56) References Cited

U.S. PATENT DOCUMENTS 3,892,917 A * 7/1975 Sotome ..... H04R 5/00 381/17
5,253,301 A * 10/1993 Sakamoto ..... H04R 1/2826 181/145
5,388,162 A * 2/1995 Sohn ..... H04R 1/227 181/146
5,995,634 A * 11/1999 Zwolski ..... H04R 1/028 181/155
6,285,772 B1 * 9/2001 Tate ..... H04R 1/406 379/433.03
7,796,775 B2 * 9/2010 Oxford ..... H04R 1/26 381/345

(Continued)

FOREIGN PATENT DOCUMENTS

TW 201138482 A 11/2011

OTHER PUBLICATIONS

Office Action issued in corresponding Taiwan patent application dated Jun. 13, 2019.

*Primary Examiner* — Sean H Nguyen
(74) *Attorney, Agent, or Firm* — Muncy, Geissler, Olds & Lowe, P.C.

(57) ABSTRACT

A composite speaker module includes a vibration damper sheet, a first sound guide assembly, a first speaker driver, a second sound guide assembly, and a second speaker driver. The vibration damper sheet includes a first surface and a second surface opposite to the first surface. The first sound guide assembly includes a first sound guide and a first bracket. The first sound guide disposed on the first surface. The first bracket is connected to the first sound guide and extends away from the vibration damper sheet. The first speaker driver is disposed on the first bracket. The second sound guide assembly includes a second sound guide and a second bracket. The second sound guide disposed on the second surface. The second bracket is connected to the second sound guide and extends along a direction away from the vibration damper sheet. The second speaker driver is disposed on the second bracket.

17 Claims, 8 Drawing Sheets

(56) References Cited

U.S. PATENT DOCUMENTS

| | | | | |
|---|---|---|---|---|
| 2007/0160246 | A1* | 7/2007 | Vollmer | H04R 1/323<br>381/336 |
| 2012/0201403 | A1* | 8/2012 | Tan | H04R 1/345<br>381/182 |
| 2017/0064421 | A1* | 3/2017 | Matsumura | H04R 1/025 |

* cited by examiner

COMPOSITE SPEAKER MODULE AND SPEAKER DEVICE

CROSS-REFERENCE TO RELATED APPLICATION

This non-provisional application claims priority under 35 U.S.C. § 119(a) to Patent Application No. 107115122 filed in Taiwan, R.O.C. on May 3, 2018, the entire contents of which are hereby incorporated by reference.

BACKGROUND

Technical Field

The instant disclosure generally relates to an audio playback device and, more particularly, to a composite speaker module and a speaker device.

Related Art

Speakers are very common audio playback devices, which convert an electrical signal from an amplifier into a mechanical vibration of the diaphragm to cause a density change of the surrounding air to produce an audio sound.

Generally speaking, a speaker has a housing and a sound box disposed in the housing. There are correspondingly assembled mechanisms between the sound box and the housing. For example, both the sound box and the housing are provided with screw-locking mechanisms for fastening the components thereof through screws. In addition, in order to avoid resonance of the sound box, an anti-vibration mechanism may be additionally provided between the sound box and the housing. However, for a speaker with multiple sound boxes, an assembled mechanism and an anti-vibration mechanism are required between each of the sound boxes and the housing, which results in a complicated speaker structure design and a large overall volume.

SUMMARY

In view of the above, in one embodiment, a composite speaker module is provided including a vibration damper sheet, a first sound guide assembly, a first speaker driver, a second sound guide assembly, and a second speaker driver. The vibration damper sheet includes a first surface and a second surface opposite to the first surface. The first sound guide assembly includes a first sound guide and a first bracket. The first sound guide includes a first bottom fixedly disposed on the first surface of the vibration damper sheet. The first bracket is connected to the first sound guide and extends along a direction away from the vibration damper sheet. The first speaker driver is fixedly disposed on the first bracket and faces the first sound guide. The first speaker driver and the first sound guide are separated by a first spacing. The second sound guide assembly includes a second sound guide and a second bracket. The second sound guide includes a second bottom fixedly disposed on the second surface of the vibration damper sheet. The second bracket is connected to the second sound guide and extends along a direction away from the vibration damper sheet. The second speaker driver is fixedly disposed on the second bracket and faces the second sound guide. The second speaker driver and the second sound guide are separated by a second spacing.

Concisely, according to embodiments of the instant disclosure, a composite speaker module is mounted on a first surface of a vibration damper sheet through a first sound guide assembly and a first speaker driver, and is mounted on a second surface of the vibration damper sheet through a second sound guide assembly and a second speaker driver, such that the space occupied by the composite speaker module can be reduced. The composite speaker module can be pre-assembled and can be independently tested. In addition, after the test is completed, the composite speaker module can be assembled in the product housing through only the assembly portion on the vibration damper sheet, thereby reducing the time for manufacturing and assembly, and improving the process and the product yield.

BRIEF DESCRIPTION OF THE DRAWINGS

This disclosure will become more fully understood from the detailed description given herein below for illustration only, and thus not limitative of this disclosure, wherein.

DETAILED DESCRIPTION

Figure 1:
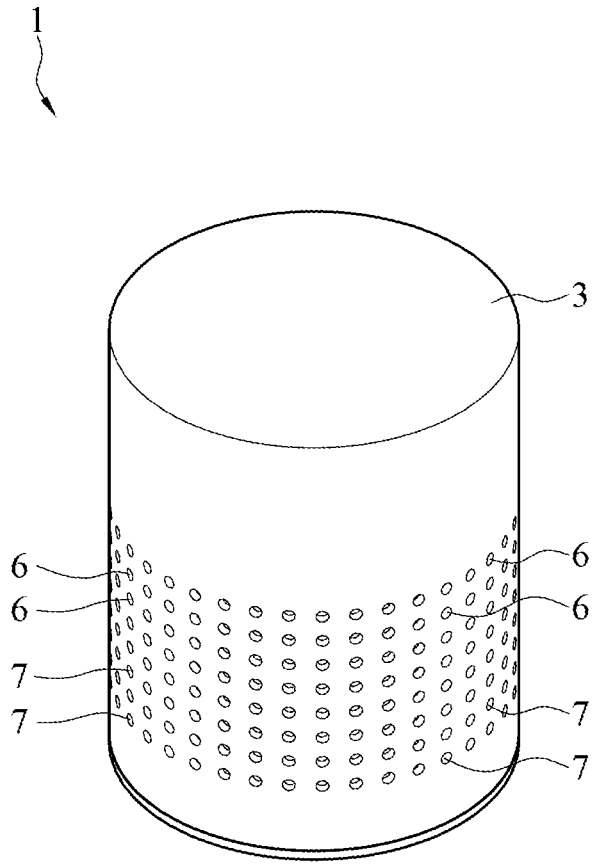
FIG. 1 is a perspective view of a speaker device according to a first embodiment of the instant disclosure.
Figure 2:
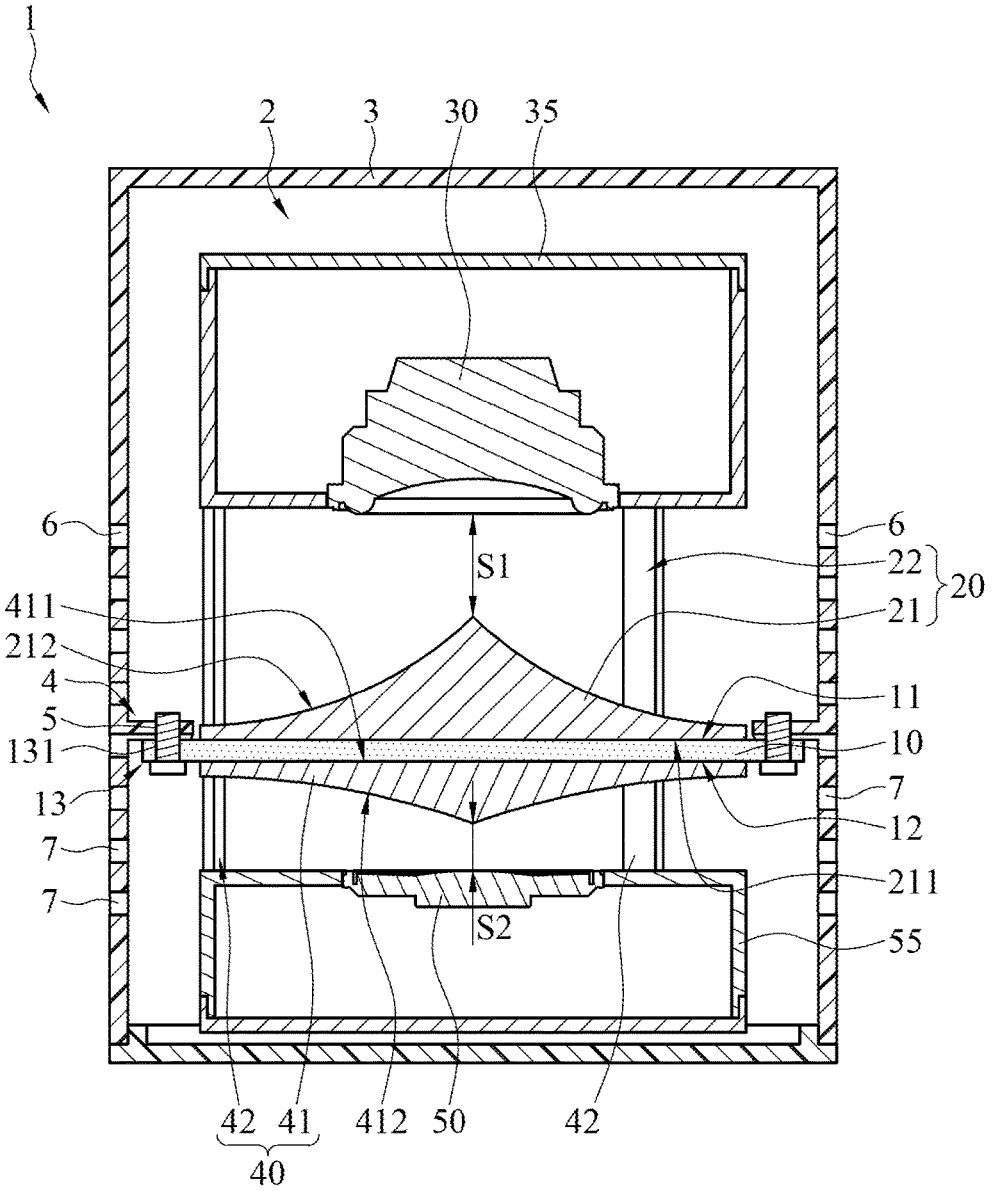
FIG. 2 is a cross-sectional view of a speaker device according to a first embodiment of the instant disclosure.
Figure 3:
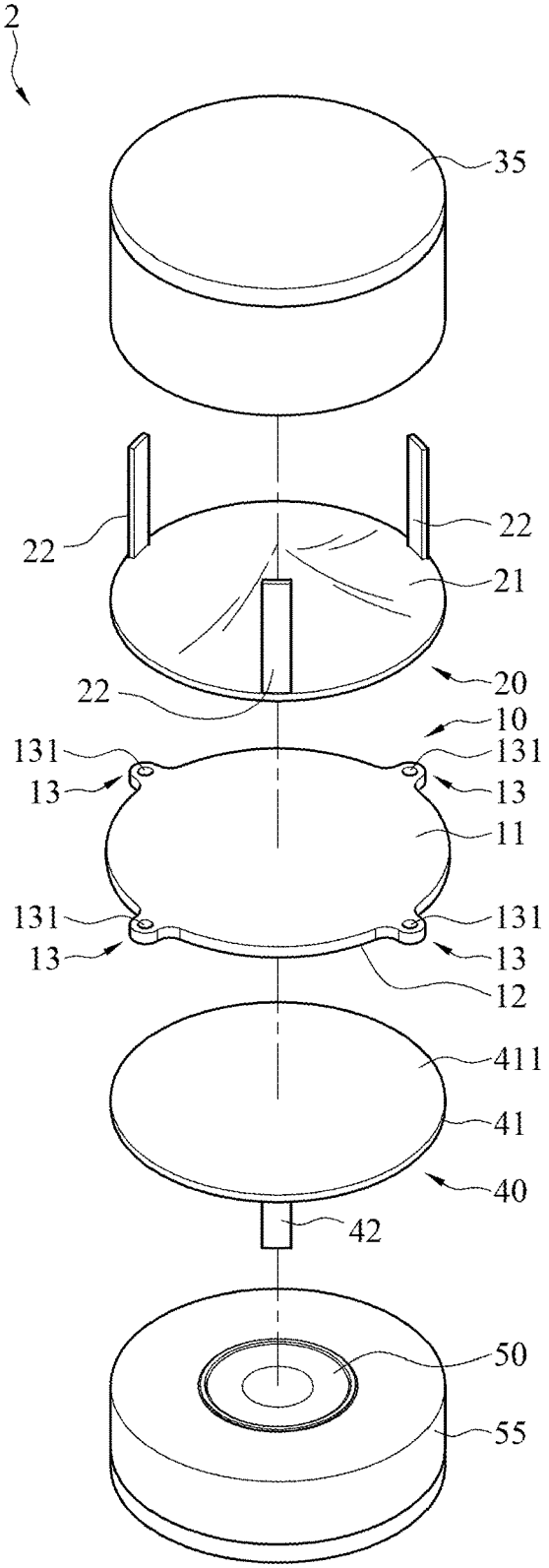
FIG. 3 is an exploded perspective view of a speaker device according to a first embodiment of the instant disclosure.

FIG. 1, FIG. 2, and FIG. 3 show a perspective view, a cross-sectional view, and an exploded perspective view, respectively, of a speaker device according to a first embodiment of the instant disclosure. As shown in FIG. 1 and FIG. 2, the speaker device 1 includes a composite speaker module 2 and a housing 3. In this embodiment, the speaker device 1 is an upright speaker, as an example, that can be placed on the surface of an object (such as on the desk or on the floor), to which the instant disclosure is not limited. In some embodiments, the speaker device 1 may also be an in-wall speaker, a suspended speaker or other different types of speakers.

As shown in FIG. 2 and FIG. 3, the composite speaker module 2 is installed inside the housing 3. The composite speaker module 2 includes a vibration damper sheet 10, a first sound guide assembly 20, a first speaker driver 30, a second sound guide assembly 40, and a second speaker driver 50. The vibration damper sheet 10 is a sheet with a thickness and is disposed between the first speaker driver 30 and the second speaker driver 50 to alleviate the problem that the sounds generated by the two speaker drivers cancel each other out. In this embodiment, the vibration damper sheet 10 is a circular sheet, to which the instant disclosure is not limited. The vibration damper sheet 10 may also be a sheet of other shapes (such as square, rectangular or other irregular shapes), which depends on the actual shape of the product using the same. In some embodiments, the vibration damper sheet 10 may be an elastic sheet with vibration damping. For example, the vibration damper sheet 10 may be a foam sheet, a rubber sheet, or a plastic sheet made of thermoplastic polyurethane (TPU), a thermoplastic elastomer (TPE), a thermoplastic polyester elastomer (TPEE), thermoplastic styrene (TPEE) or polycarbonate (PC), or combination thereof.

As shown in FIG. 2 and FIG. 3, in this embodiment, the vibration damper sheet 10 includes a first surface 11 and a second surface 12 opposite to the first surface 11. In other words, the first surface 11 and the second surface 12 are on opposite sides of the vibration damper sheet 10. The first sound guide assembly 20 includes a first sound guide 21 and a first bracket 22. In some embodiments, the first sound guide 21 may be a cone formed of a hard material (such as plastic, metal, ceramic or acrylic, etc.) or a soft material (such as plastic or rubber, etc.) to guide the sound waves outputted by the first speaker driver 30. In addition, the first sound guide 21 may be a solid cone or a hollow cone, to which the instant disclosure is not limited. In particular, the first sound guide 21 includes a first bottom 211 fixedly disposed on the first surface 11 of the vibration damper sheet 10. For example, the first bottom 211 of the first sound guide 21 is fixedly disposed on the first surface 11 by adhesion, locking, snapping, card insertion, or integral molding. Similarly, the second sound guide assembly 40 includes a second sound guide 41 and second bracket 42. The second bottom 411 of the second sound guide 41 is fixedly disposed on the second surface 12 of the vibration damper sheet 10. The way the second sound guide 41 is fixedly disposed on the second surface 12 may be the same as or different from the way the first sound guide 21 is fixedly disposed on the first surface 11. The combination of the vibration damper sheet 10 with the first sound guide 21 and the second sound guide 41 will be further described herein.

Figure 4:
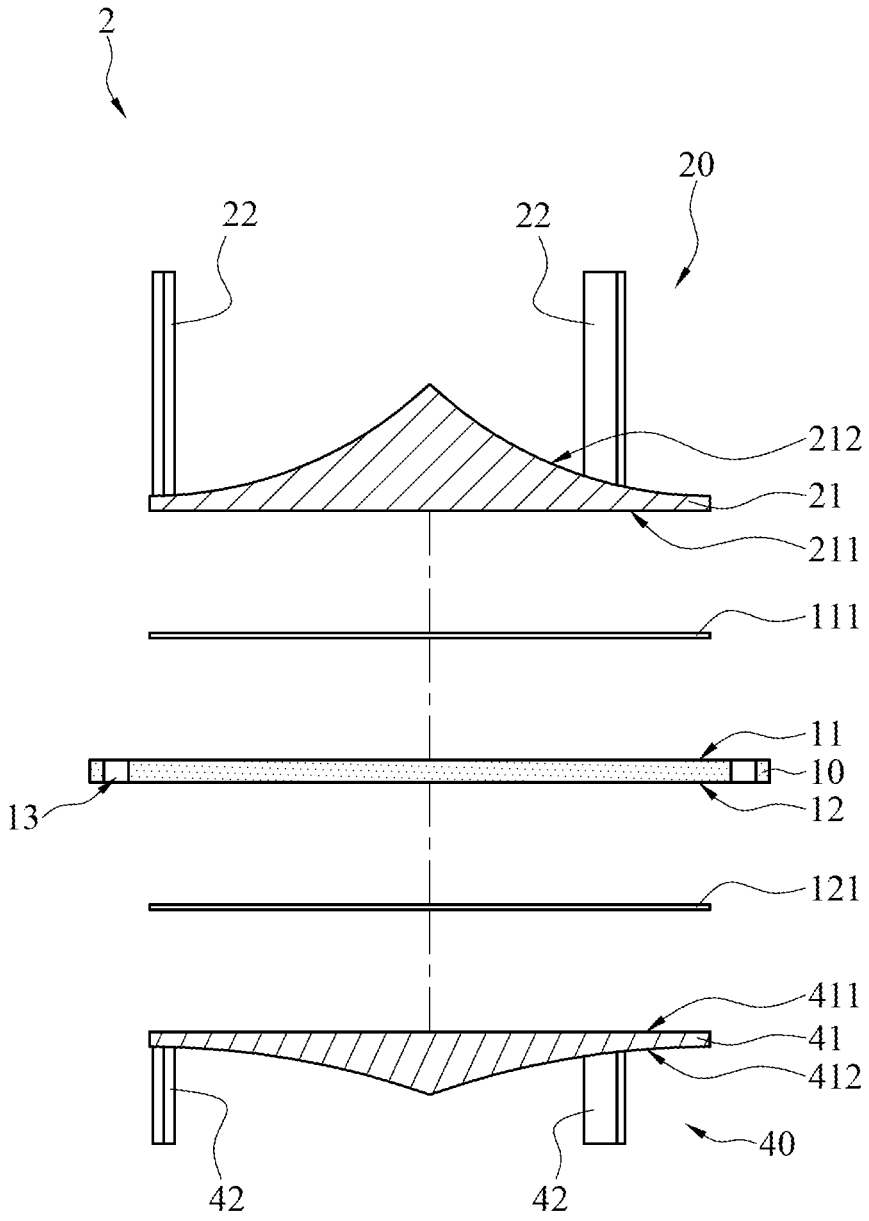
FIG. 4 is a local cross-sectional view of a speaker device according to a first embodiment of the instant disclosure.

As shown in FIG. 4, in this embodiment, on the first surface 11 and the second surface 12 of the vibration damper sheet 10 of the composite speaker module 2 are provided with an adhesive layer 111 and 121, respectively. For example, the adhesive layer 111 and 121 can be made of acrylic type (such as cyanoacrylate), polysulfide type, polyurethane type, or silicone adhesive. The first bottom 211 of the first sound guide 21 (i.e., the bottom surface of the first sound guide 21) can be fixedly adhered onto the first surface 11 of the vibration damper sheet 10 corresponding to the adhesive layer 111. The second bottom 411 of the second sound guide 41 can be fixedly adhered onto the second surface 12 corresponding to the adhesive layer 121.

Figure 5:
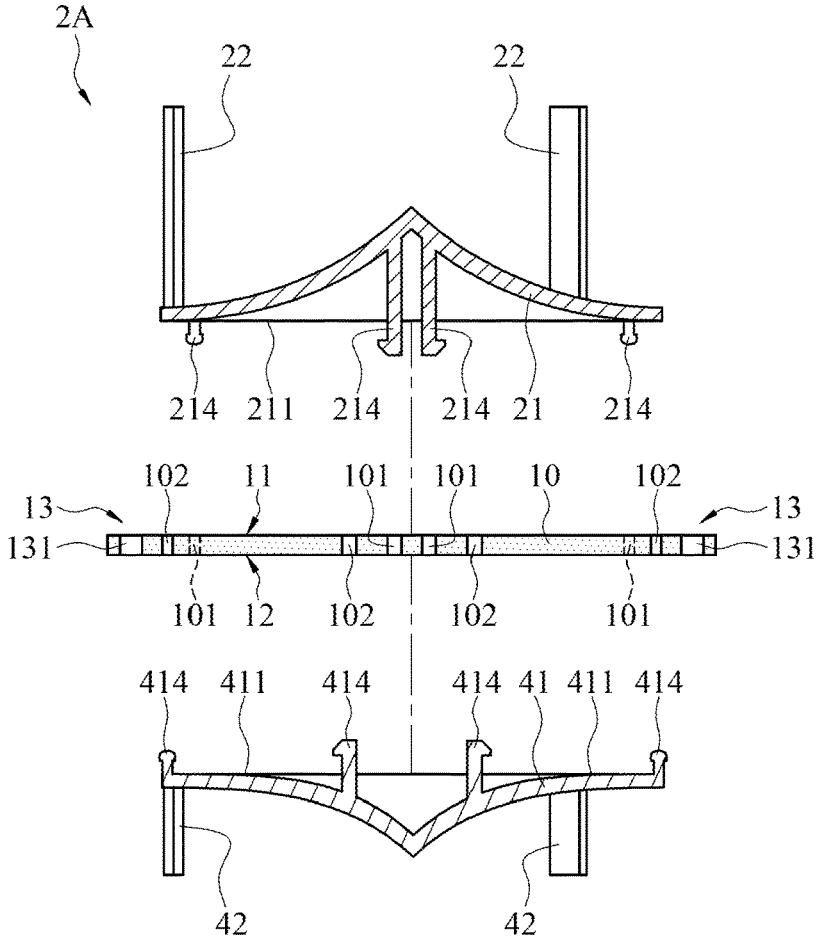
FIG. 5 is a local cross-sectional view of a speaker device according to a second embodiment of the instant disclosure.

Alternatively, as shown in FIG. 5, in another embodiment, the vibration damper sheet 10 of the composite speaker module 2A is provided with at least one first button hole 101 (a plurality of first button holes 101 in this embodiment) and at least one second button hole 102 (a plurality of second button hole 102 in this embodiment). The first bottom 211 of the first sound guide 21 is convexly provided with a plurality of first fasteners 214 corresponding to respective first button holes 101. The second bottom 411 of the second sound guide 41 is convexly provided with a plurality of second fasteners 414 corresponding to respective second button holes 102. The first fasteners 214 and the second fasteners 414 may be a barb or a bolt, to which the instant disclosure is not limited. The first sound guide 21 is snap-fastened to respective first button holes 101 through the first fasteners 214 such that the first sound guide 21 is fixedly disposed on the vibration damper sheet 10. The second sound guide 41 is snap-fastened to respective second button holes 102 through the second fastener 414 such that the second sound guide 41 is fixedly disposed on the vibration damper sheet 10. In this embodiment, when both the first sound guide 21 and the second sound guide 41 are fixedly disposed on the vibration damper sheet 10 in a snap-fastening manner, the first button holes 101 and the second button holes 102 on the vibration damper sheet 10 can be dislocated from each other so as to prevent the first sound guide 21 and the second sound guide 41 from interfering or contacting with each other to cause a resonance problem.

Figure 6:
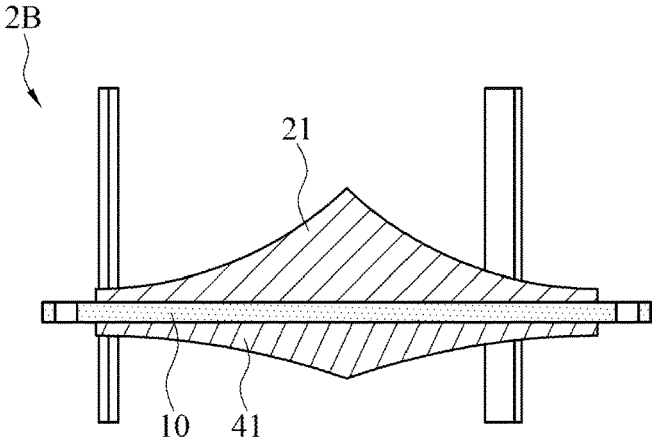
FIG. 6 is a local cross-sectional view of a speaker device according to a third embodiment of the instant disclosure.

Alternatively, as shown in FIG. 6, in another embodiment, the first sound guide 21 and the second sound guide 41 of the composite speaker module 2B can be fixedly disposed on the first surface 11 and the second surface 12, respectively, of the vibration damper sheet 10 by double injection molding so as to further reduce the time for manufacturing and assembly and improve the process and the structural strength.

The embodiments as shown in FIG. 4, FIG. 5 and FIG. 6 are only exemplary. In fact, the first sound guide 21 may also be fixedly disposed on the vibration damper sheet 10 through other ways (for example, locking or embedding). In other embodiments, the first sound guide 21 and the second sound guide 41 may also be fixedly disposed on the vibration damper sheet 10 in different ways. For example, in some embodiments, the first sound guide 21 is fixedly disposed on the vibration damper sheet 10 in a snap-fastening manner, while the second sound guide 41 is fixedly disposed on the vibration damper sheet 10 in an adhesive manner. Alternatively, the first sound guide 21 is fixedly disposed on the vibration damper sheet 10 by injection molding, while the second sound guide 41 is fixedly disposed on the vibration damper sheet 10 by snap-fastening.

As shown in FIG. 2 and FIG. 3, the first bracket 22 of the first sound guide assembly 20 of the composite speaker module 2 is connected to the first sound guide 21 and extends along a direction away from the vibration damper sheet 10. In other words, the first bracket 22 extends perpendicular to the vibration damper sheet 10. The first speaker driver 30 is fixedly disposed on the first bracket 22 so that the first speaker driver 30 is separated from the first sound guide 21 by a first spacing S1 (where the first spacing S1 is the linear distance between the top of the first sound guide 21 and the first speaker driver 30). The sound outlet of the first speaker driver 30 faces the first sound guide 21. On the other hand, the second bracket 42 of the second sound guide assembly 40 is connected to the second sound guide 41 and extends perpendicularly away from the vibration damper sheet 10. In other words, the first bracket 22 of the first sound guide assembly 20 extends along a direction opposite to the direction the second bracket 42 of the second sound guide assembly 40 extends along. The second speaker driver 50 is fixedly disposed on the second bracket 42 such that the second speaker driver 50 and the second sound guide 41 are separated by a second spacing S2. The sound outlet of the second speaker driver 50 faces the second sound guide 41. In some embodiments, the first speaker driver 30 and the second speaker driver 50 may be various types of speakers, such as an electrodynamic speaker, an electromagnetic speaker, a piezoelectric speaker, an electrode speaker, or a plasma speaker, to which the instant disclosure is not limited.

In some embodiments, the first speaker driver 30 may be directly or indirectly fixed onto the first bracket 22. As shown in FIG. 2 and FIG. 3, the first speaker driver 30 may be enclosed by a first sound box 35, and the first sound box 35 is fixedly disposed (for example, by adhesion, locking, or snapping) on the first bracket 22 such that the first speaker driver 30 can be indirectly fixed onto the first bracket 22. In other embodiments, the first speaker driver 30 may also be directly fixed onto the first bracket 22 without being enclosed by the first sound box 35, to which the instant disclosure is not limited. Similarly, the second speaker driver 50 may be directly or indirectly fixed onto the second bracket 42. In some embodiments, the second speaker driver 50 may be enclosed by a second sound box 55 such that the second speaker driver 50 may be indirectly fixed onto the second bracket 42 through the second sound box 55. In other embodiments, the second speaker driver 50 may also be directly fixed onto the second bracket 42 without being enclosed by the second sound box 55.

As shown in FIG. 2 and FIG. 3, the vibration damper sheet 10 is provided with an assembly portion 13 disposed on a periphery thereof. The housing 3 is provided with a combining portion 4 disposed therein. The composite speaker module 2 is fixedly assembled with the combining portion 4 through the assembly portion 13 of the vibration damper sheet 10. In some embodiments, the assembly portion 13 and the combining portion 4 are structures that can be assembled with each other. For example, in the embodiments as shown in FIG. 2 and FIG. 3, the assembly portion 13 includes a plurality of openings 131 disposed on the periphery of the vibration damper sheet 10, and the combining portion 4 includes a plurality of keyholes 5 corresponding to the above-mentioned openings 131. Accordingly, the composite speaker module 2 can be fixedly disposed inside the housing 3 by using a plurality of screws respectively passing through the openings 131 to be locked on the keyholes 5. However, the above-mentioned embodiments of the assembly portion 13 and the combining portion 4 are only exemplary. The assembly portion 13 and the combining portion 4 may also be corresponding fasteners, adhesive layers, or the like, to which the instant disclosure is not limited.

Since the prior art requires that a plurality of speaker drivers and a plurality of sound guide assemblies be individually attached onto the inside of the product housing, an assembly mechanism and an anti-vibration mechanism are required to be provided on each of the components, resulting in a large volume of the product, high mechanism complexity, and long time consuming in the assembly process. In addition, the whole device can be tested only after all the components are assembled into the housing. When the product is tested to have a problem, the product has to be disassembled, the internal components have to be replaced and then the product can be reassembled, resulting in poor assembly efficiency.

Therefore, in the instant disclosure, a first set of speaker structures (including the first sound guide assembly 20 and the first speaker driver 30) and a second set of speaker structures (including the second sound guide assembly 40 and the second speaker driver 50) are assembled on the same vibration damper sheet 10 to form a composite speaker module 2. Thus, the two speaker structures can be damped through the vibration damper sheet 10 instead of using an assembly mechanism and an anti-vibration mechanism. Accordingly, the complexity of the mechanism can be reduced, the overall device volume can be downsized, and the manufacturing cost can be reduced. In addition, the composite speaker module 2 can be assembled into the product housing 3 using only one vibration damper sheet 10, thereby eliminating the complicated process of assembling each component into the housing 3 in the prior art. Moreover, the composite speaker module 2 in the instant disclosure can be tested in advance and then assembled into the housing 3, further reducing the time for assembly and improving the process and the product yield.

In addition, with the arrangement of the composite speaker module 2 in the above embodiments, the mutual interference (such as resonance or sound waves interaction) between the first speaker driver 30 and the second speaker driver 50 during operation can be avoided. Detailed descriptions will be presented with accompanying figures.

Figure 7:
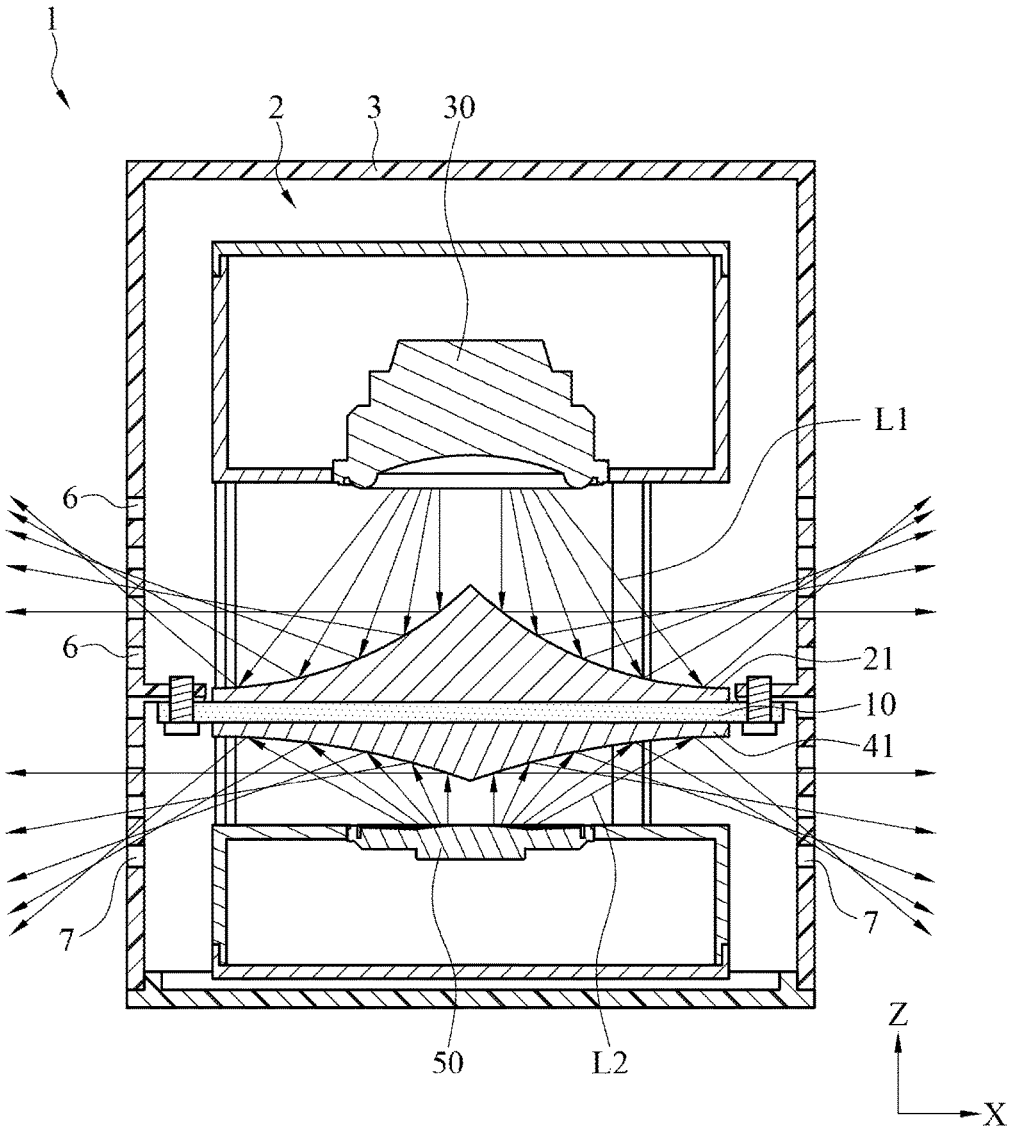
FIG. 7 is a schematic view showing the operation of a speaker device according to a first embodiment of the instant disclosure.

Please refer to FIG. 2 and FIG. 7, where FIG. 7 is a schematic view showing the operation of a speaker device according to a first embodiment of the instant disclosure. In this embodiment, during the operation of the first speaker driver 30 and the second speaker driver 50, the sound waves generated by the first speaker driver 30 are transmitted towards the first sound guide 21 (as indicated by arrow L1 in the figure) because the first speaker driver 30 faces toward the first sound guide 21. When the sound waves are transmitted to the first sound guide 21, the sound waves can be changed to be transmitted along the horizontal direction (as shown in the X-axis direction in the figure) through the guidance of the conical surface of the first sound guide 21. The housing 3 is provided with a plurality of first sound outlets 6 corresponding to the periphery of the first sound guide 21. Therefore, the horizontal sound waves can be transmitted by the first sound outlets 6 in all directions from the speaker device 1 such that the sound can be heard in any position in the space where the speaker device 1 is located. Similarly, since the second speaker driver 50 faces the second sound guide 41, the sound waves transmitted by the second speaker driver 50 is transmitted towards the second sound guide 41 (as indicated by arrow L2 in the figure). When the sound waves are transmitted to the second sound guide 41, the sound waves can be changed to be transmitted along the horizontal direction (as shown in the X-axis direction in the figure) through the guidance of the conical surface of the second sound guide 41. The housing 3 is provided with a plurality of second sound outlets 7 corresponding to the periphery of the second sound guide 41 such that the horizontal sound waves are transmitted by the second sound outlets 7 in all directions from the speaker device 1. It should be further explained that, in FIG. 2 and FIG. 7, only the first sound outlets 6 and the second sound outlets 7 in the cross section are shown, while the other first sound outlets 6 and the other second sound outlets 7 are omitted so as to clearly show the components inside the housing 3.

In this way, the sound waves from the first speaker driver 30 are guided by the first sound guide 21 to travel in the horizontal direction, and the sound waves from the second speaker driver 50 are guided by the second sound guide 41 to travel in the horizontal direction. The vibration damper sheet 10 is blocked between the first speaker driver 30 and the second speaker driver 50 to effectively prevent the sound waves from the first speaker driver 30 and from the second speaker driver 50 from interfering with or canceling each other. In addition, the first sound guide assembly 20, the first speaker driver 30, the second sound guide assembly 40, and the second speaker driver 50 may also use the vibration damper sheet 10 to achieve vibration reduction.

As shown in FIG. 2 and FIG. 3, in some embodiments, the first spacing S1 between the first speaker driver 30 and the first sound guide 21 and the second spacing S2 between the second speaker driver 50 and the second sound guide 41 may be set to be the same or different according to different requirements. For example, when the first speaker driver 30 and the second speaker driver 50 are different (for example, when the first speaker driver 30 is a subwoofer and the second speaker driver 50 is a tweeter), the first spacing S1 and the second spacing S2 are set differently. When the first speaker driver 30 and the second speaker driver 50 are the same, the first spacing S1 and the second spacing S2 are set to be identical, to which the instant disclosure is not limited.

In some embodiments, the conical surface of the first sound guide 21 may be a non-linear conical surface or a linear conical surface, and the conical surface of the second sound guide 41 may also be a non-linear conical surface or a linear conical surface. In addition, the conical surface of the first sound guide 21 and the conical surface of the second sound guide 41 may also be set to be the same or different according to different requirements.

For example, in this embodiment as shown in FIG. 2, the first sound guide 21 includes a first non-linear conical surface 212 (here, a curved surface), and the second sound guide 41 includes a second non-linear conical surface 412 (here, a curved surface). When the first speaker driver 30 and the second speaker driver 50 are different (for example, the first speaker driver 30 is a subwoofer, and the second speaker driver 50 is a tweeter), the curvature of the first non-linear conical surface 212 and the curvature of the second non-linear conical surface 412 are set to be different. For example, in this embodiment, the curvature of the first non-linear conical surface 212 is greater than the curvature of the second non-linear conical surface 412. In other embodiments, the first non-linear conical surface 212 and the second non-linear conical surface 412 may also have different curvature configurations according to other factors (such as different setting environments or special audio requirements), to which the instant disclosure is not limited.

Figure 8:
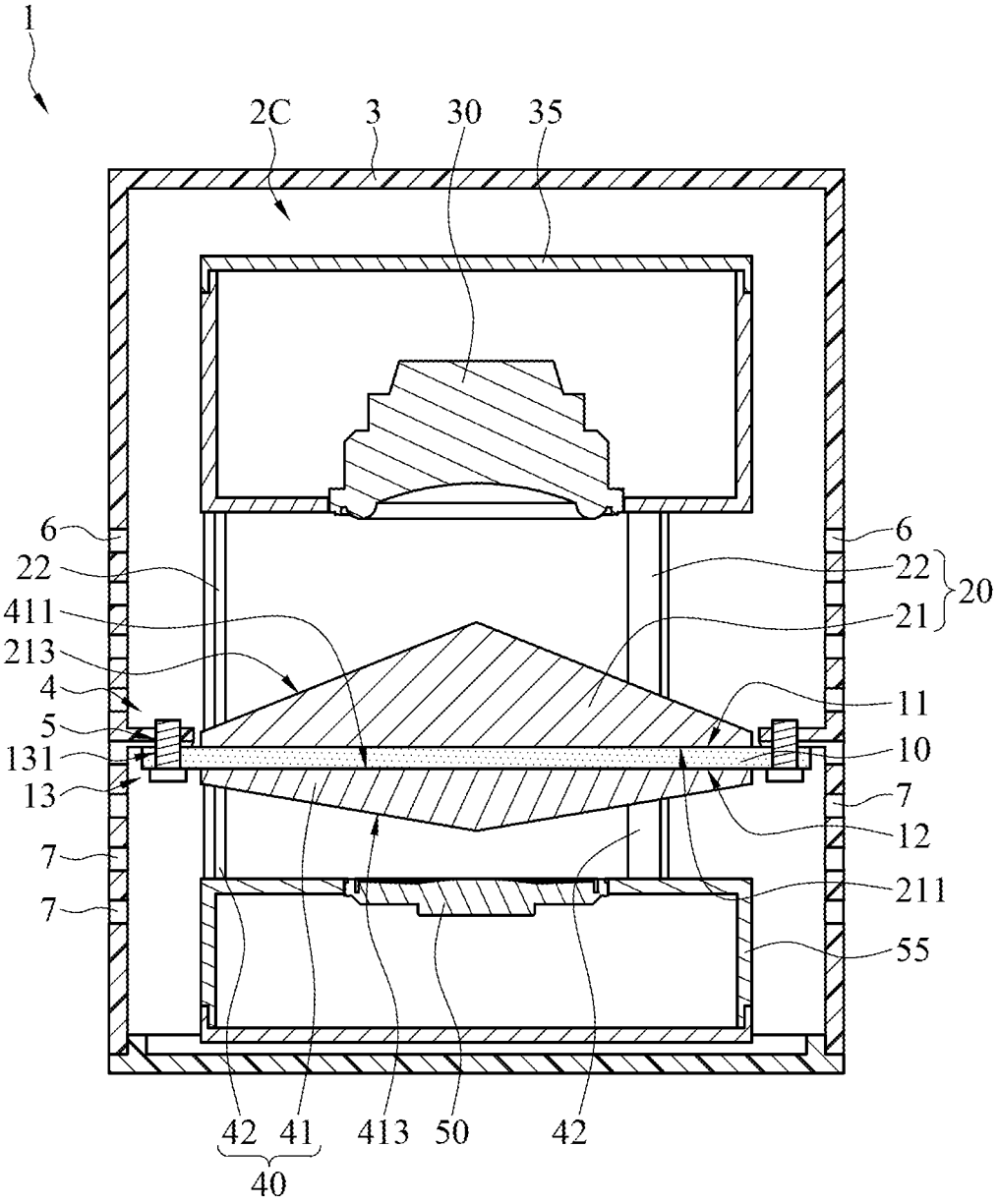
FIG. 8 is a cross-sectional view of a speaker device according to a fourth embodiment of the instant disclosure.

In some embodiments, as shown in FIG. 8, the first sound guide 21 of the composite speaker module 2C includes a first linear conical surface 213 (here, the cross section of the first linear conical surface 213 has a slant), and the second sound guide 41 includes a second linear conical surface 413 (here, the cross section of the second linear conical surface 413 has a slant). When the first speaker driver 30 and the second speaker driver 50 are different (for example, the first speaker driver 30 is a subwoofer, and the second speaker driver 50 is a tweeter), the slope of the first linear conical surface 213 and the slope of the second linear conical surface 413 are set to be different. For example, in this embodiment, the slope of the first linear conical surface 213 is greater than the slope of the second linear conical surface 413, to which the instant disclosure is not limited.

Figure 9:
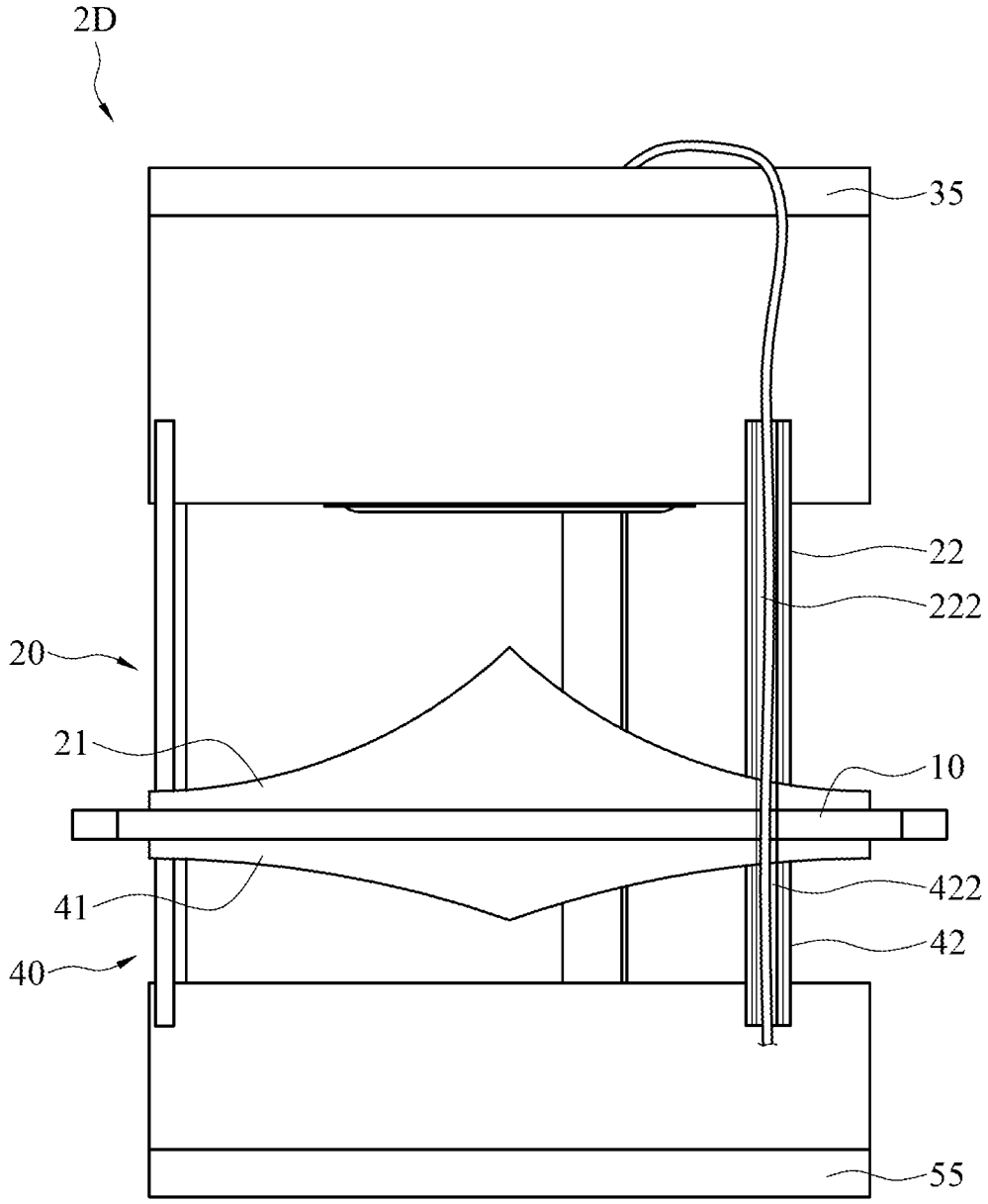
FIG. 9 is a side view of a speaker device according to a fifth embodiment of the instant disclosure.

In some embodiments, at least one of the first bracket 22 of the first sound guide assembly 20 and the second bracket 42 of the second sound guide assembly 40 may be provided with a cable trough. As shown in FIG. 9, on one side of the first bracket 22 of the composite speaker module 2D is provided with a cable trough 222, which extends along the same direction as the first bracket 22. On the outer side of one of the second brackets 42 is provided with a cable trough 422, which is serially connected to the cable trough 222 of the first bracket 22, such that the cables of the first speaker driver 30 and the second speaker driver 50 can be accommodated in the cable troughs 222, 422 to prevent the cables from being wound and improve assembly convenience.

What is claimed is:

1. A composite speaker module, comprising:

a vibration damper sheet comprising a first surface and a second surface opposite to said first surface;

a first sound guide assembly comprising a first sound guide and a first bracket, said first sound guide comprising a first bottom fixedly disposed on said first surface of said vibration damper sheet, said first bracket being connected to said first sound guide and extending along a direction away from said vibration damper sheet;

a first speaker driver fixedly disposed on said first bracket and facing said first sound guide, said first speaker driver and said first sound guide being separated by a first spacing;

a second sound guide assembly comprising a second sound guide and a second bracket, said second sound guide comprising a second bottom fixedly disposed on said second surface of said vibration damper sheet, said second bracket being connected to said second sound guide and extending along a direction away from said vibration damper sheet; and a second speaker driver fixedly disposed on said second bracket and facing said second sound guide, said second speaker driver and said second sound guide being separated by a second spacing.

2. The composite speaker module according to claim 1, wherein said first sound guide comprises a non-linear conical surface or a linear conical surface and said second sound guide comprises a non-linear conical surface or a linear conical surface.

3. The composite speaker module according to claim 1, wherein said first spacing is different from said second spacing.

4. The composite speaker module according to claim 1, wherein said first surface of said vibration damper sheet is provided with an adhesive layer disposed thereon, by which said first bottom of said first sound guide is fixedly adhered onto said first surface.

5. The composite speaker module according to claim 1, wherein said vibration damper sheet is provided with at least one first button hole and said first bottom of said first sound guide is provided with at least one first fastener, such that said first sound guide uses said at least one first fastener be to fastened with at least one first button hole.

6. The composite speaker module according to claim 1, wherein said first sound guide and said second sound guide are both fixedly disposed on said vibration damper sheet by using double injection molding.

7. The composite speaker module according to claim 1, further comprising a first sound box fixedly disposed on said first bracket and enclosing said first speaker driver.

8. The composite speaker module according to claim 7, further comprising a second sound box fixedly disposed on said second bracket and enclosing said second speaker driver.

9. A speaker device, comprising:

a composite speaker module, comprising:

a vibration damper sheet comprising a first surface and a second surface opposite to said first surface;

a first sound guide assembly comprising a first sound guide and a first bracket, said first sound guide comprising a first bottom fixedly disposed on said first surface of said vibration damper sheet, said first bracket being connected to said first sound guide and extending along a direction away from said vibration damper sheet;

a first speaker driver fixedly disposed on said first bracket and facing said first sound guide, said first speaker driver and said first sound guide being separated by a first spacing;

a second sound guide assembly comprising a second sound guide and a second bracket, said second sound guide comprising a second bottom fixedly disposed on said second surface of said vibration damper sheet, said second bracket being connected to said second sound guide and extending along a direction away from said vibration damper sheet; and a second speaker driver fixedly disposed on said second bracket and facing said second sound guide, said second speaker driver and said second sound guide being separated by a second spacing.

10. The speaker device according to claim 9, further comprising a housing being provided with a combining portion disposed therein, said vibration damper sheet being provided with an assembly portion disposed on a periphery thereof, such that said composite speaker module is fixedly assembled with said combining portion through said assembly portion of said vibration damper sheet.

11. The speaker device according to claim 9, wherein said first sound guide comprises a non-linear conical surface or a linear conical surface and said second sound guide comprises a non-linear conical surface or a linear conical surface.

12. The speaker device according to claim 9, wherein said first spacing is different from said second spacing.

13. The speaker device according to claim 9, wherein said first surface of said vibration damper sheet is provided with an adhesive layer disposed thereon, by which said first bottom of said first sound guide is fixedly adhered onto said first surface.

14. The speaker device according to claim 9, wherein said vibration damper sheet is provided with at least one first button hole and said first bottom of said first sound guide is provided with at least one first fastener, such that said first sound guide uses said at least one first fastener be to fastened with at least one first button hole.

15. The speaker device according to claim 9, wherein said first sound guide and said second sound guide are both fixedly disposed on said vibration damper sheet by using double injection molding.

16. The speaker device according to claim 9, further comprising a first sound box fixedly disposed on said first bracket and enclosing said first speaker driver.

17. The speaker device according to claim 16, further comprising a second sound box fixedly disposed on said second bracket and enclosing said second speaker driver.

* * * * *